United States Patent [19]

Soltes

[11] 4,245,377

[45] Jan. 20, 1981

[54] JEWELRY CHAIN CLASP

[76] Inventor: Isaac B. Soltes, 1923 S. McPherrin Ave., Monterey Park, Calif. 91754

[21] Appl. No.: 927,629

[22] Filed: Jul. 24, 1978

[51] Int. Cl.[3] ..... A44B 11/25

[52] U.S. Cl. ..... 24/230 R

[58] Field of Search ..... 24/230 R, 230 AS, 241 S, 24/231; 59/91, 85

[56] References Cited

U.S. PATENT DOCUMENTS

| | | | |
|---|---|---|---|
| 109,666 | 11/1870 | Richards | 24/230 R X |
| 206,335 | 7/1878 | Kampf | 59/85 |
| 443,245 | 12/1890 | Traut | 24/230 R X |
| 707,682 | 8/1902 | Fairbrother, Jr. | 24/230 R |
| 1,232,528 | 7/1917 | Jemmill | 24/73 HH |
| 2,805,499 | 9/1957 | Nutter, Jr. et al. | 24/230 R X |
| 3,079,657 | 3/1963 | Russell | 24/237 X |
| 3,600,917 | 8/1971 | Krock | 24/230 R X |
| 3,680,858 | 8/1972 | Ossenkop et al. | 24/115 R X |
| 3,890,800 | 6/1975 | Montague | 24/201 TR X |
| 3,979,934 | 9/1976 | Isenmann | 24/230 R X |
| 4,024,607 | 5/1977 | Rosenberg et al. | 24/230 R X |
| 4,069,558 | 1/1978 | Eberhart | 24/230 R |
| 4,122,666 | 10/1978 | Jessop | 59/91 X |

*Primary Examiner*—Philip C. Kannan

*Attorney, Agent, or Firm*—Fulwider, Patton, Rieber, Lee & Utecht

[57] ABSTRACT

A jewelry chain clasp is provided which is comprised of two unitary pieces which may be attached directly to the terminated ends of a jewelry chain. The two pieces include a spring catch arranged to be received within a receptacle which may be provided with a movable safety means for preventing inadvertent disconnection of the catch from the receptacle.

22 Claims, 15 Drawing Figures

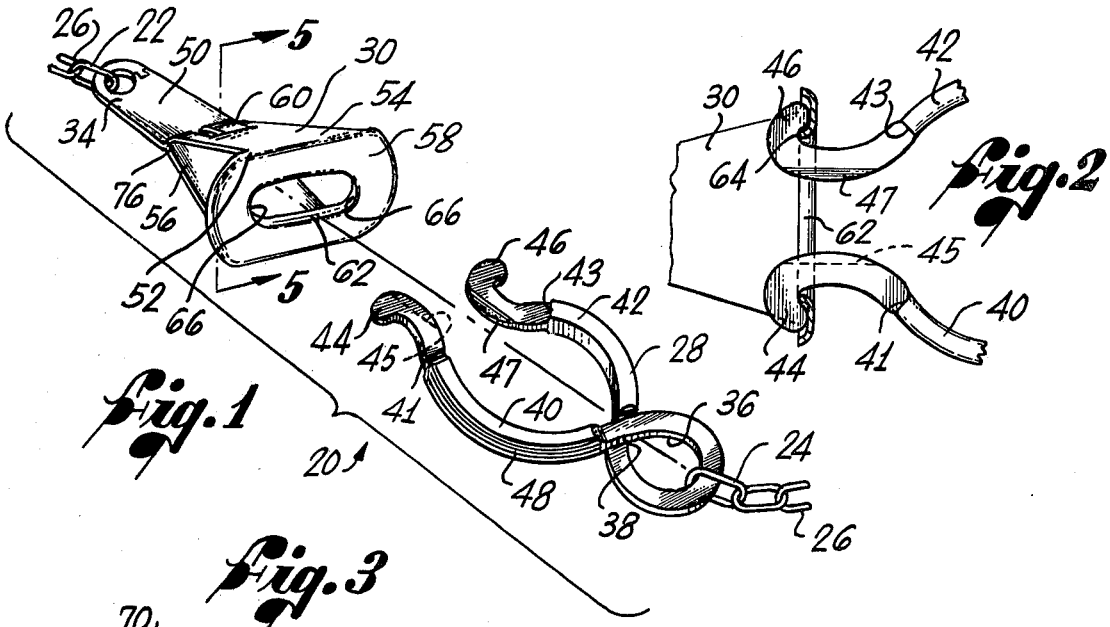
Fig. 1
Fig. 2
Fig. 3
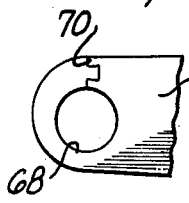
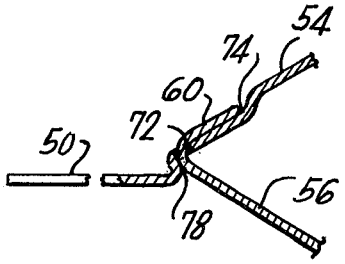
Fig. 5
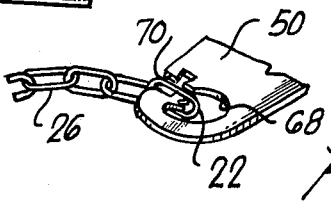
Fig. 4
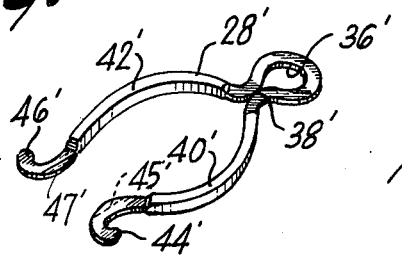
Fig. 6
Fig. 7
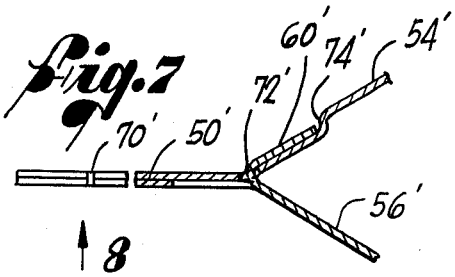
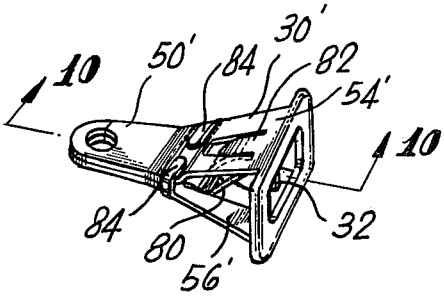
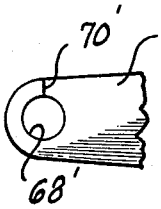
Fig. 8
Fig. 9

Fig. 10
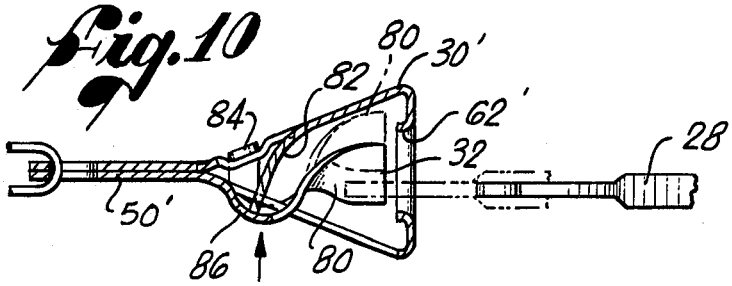
Fig. 11
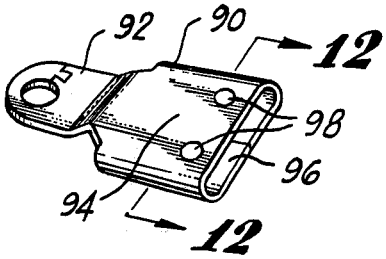
Fig. 12
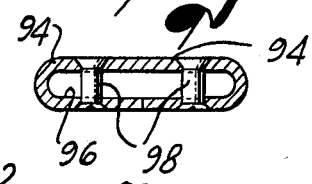
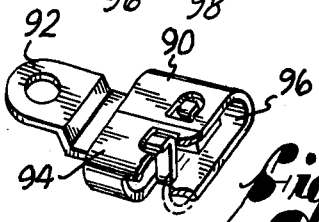
Fig. 15
Fig. 13
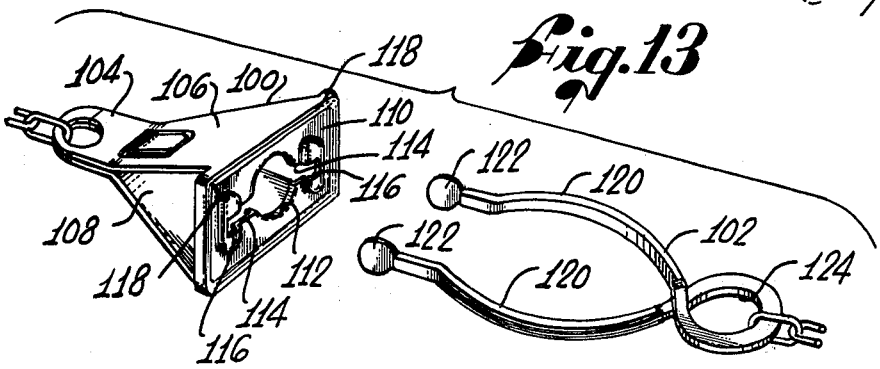
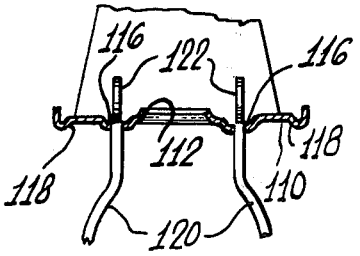
Fig. 14

JEWELRY CHAIN CLASP

BACKGROUND OF THE INVENTION

This invention relates generally to fasteners for articles of jewelry, and, more particularly, to a clasp for connecting the terminated ends of a jewelry chain.

The principal objective of this invention is to present the jewelry art a novel and improved means of connecting the ends of a jewelry chain which is convenient, reliable, secure and economical to produce. In pursuit of this objective, specific characteristics and qualities of jewelry fasteners have been studied resulting in the emergence of a set of design criteria that jewelry designers and manufacturers look for in a chain clasp. These criteria are: (1) ease of manipulation by the user; (2) secure and positive closure; (3) compactness of size; (4) aesthetic appearance; (5) strength and reliability; (6) simplicity of construction; (7) economy of manufacture; (8) ease of assembly to chain ends; (9) absence of sharp or snagging edges; and (10) application to a wide spectrum of utility.

In considering the present invention it will be helpful to view the current state of the art relating to jewlery fasteners. Many types of spring operated chain clasps are in use today, but the well known spring ring is by far the most widely used clasp throughout the jewelry industry.

The spring ring assembly consists of five pieces assembled in two parts. One part consists of a C-shaped tubular housing having a split jump ring attached to its outer surface for securing the device to one terminated end of a chain. A very small spring, usually of the helical type, is inserted into the tubular housing, and an arcuate post is arranged for reciprocal movement within the housing for spanning the open portion of the C-shaped housing and closing the ring. The housing is usually stacked or crimped in order to provide a backing against which the spring bears to urge the post into the closed position spanning the open portion of the housing, and a small tab is provided on the post to facilitate manual opening of the ring by retracting the post within the housing against the force of the spring. Since the post is generally too large to be secured directly to the last link at the opposite end of the chain, it is necessary to provide a relatively large jump ring on that link to which the spring ring fastener can be attached.

In addition to being comprised of a plurality of parts as described above, the conventional spring ring is also characterized by the disadvantage that the spring is formed of either a heat treated or cold drawn wire. If a jeweler were to attempt to secure the spring ring to the end link of a chain by employing conventional soldering techniques, he runs a substantial risk that the heat required to perform the soldering will deleteriously effect the spring. Therefore, either the split jump ring attached to the housing must be closed mechanically without use of heat, or the housing can be provided with a closed ring, and an additional jump ring can be used to safely attach the spring ring to the chain by soldering.

Accordingly, there has existed a need for a convenient and effective device for releasably connecting the terminated ends of a jewelry chain, which device is comprised of a relatively small number of parts and can be secured directly to the ends of the chain, and which conforms generally with the above criteria. As will become apparent from the following, the present invention satisfies that need.

SUMMARY OF THE INVENTION

The present invention resides in a new and improved jewelry chain clasp which is comprised of two unitary pieces and which can be attached directly to the terminated ends of a jewelry chain. The two pieces include a spring catch arranged to be received within a receptacle which may be provided with a movable safety means for preventing inadvertent disconnection of the catch from the receptacle. Moreover, the jewelry clasp of the present invention is relatively inexpensive to manufacture, is trouble free and reliable in use, and a means for attaching the receptacle to the chain is arranged in a novel manner for preventing inadvertent opening of the means when subjected to a tensile load in the chain.

More specifically, in the clasp of the present invention, the receptacle includes a leg at one end having an aperture through which a link of the chain is secured and a front face at its other end disposed in a plane generally perpendicular to the axis of the chain and having a central opening therein. The spring catch includes a chain link engaging loop and a pair of elongated arms each terminating in a means for engaging the receptacle adjacent the opening. Further, the present invention is arranged to present a smooth external surface to prevent the device from catching hair or scratching a user, or snagging on the user's clothing.

In one embodiment of the present invention, the receptacle includes an upper and lower wall connecting the front face to the chain receiving leg, and the opening in the front face is generally oval having an inwardly directed lip around its periphery. For cooperating with this receptacle, the means on the spring catch for engaging the receptacle is a generally flat, outwardly directed hook at the end of each elongated arm. By depressing the spring arms toward one another, the outwardly facing hooks overlap, and can be inserted through the opening. Upon releasing the arms, the hooks engage the lip at the ends of the opening thereby securing the catch to the receptacle.

In order to attach the spring catch to a terminated end of the jewelry chain, a closed loop is provided at an end of the catch opposite the hooks either by crossing the arms over one another to form a loop in a figure-eight fashion, or causing the legs to abut one another and then separate to form the loop. For attaching the receptacle directly to a chain link, an aperture is formed through the generally flat leg near the end thereof so that a single link can be secured to the receptacle by being disposed around the portion of the leg between the aperture and the end of the leg.

In order to place the link in this position, a cut is made through the leg between the aperture and one side of the leg, and by twisting the end of the leg, the leg will separate at the cut permitting a chain link to be disposed over the exposed portion of the leg. In the preferred embodiment of the present invention, the cut is made along a dove-tail shaped path between the aperture and the side of the leg so that when the chain is secured in place and the leg returned to its original position, the cut will be prevented from inadvertently opening when subjected to a tensile load in the chain.

If desired, the receptacle can be provided with a movable safety means for preventing inadvertent disconnection of the catch from the receptacle. The safety means is comprised of a tab cut out of the upper or lower wall and bent first outwardly to form a raised operating member and then inwardly ending at a position adjacent to and inside of the opening through the front face. In this position, the tab interferes with insertion or retraction of the spring catch into or out of the receptacle. By this arrangement, with the safety tab in its normal position, the spring catch is prevented from inadvertently disconnecting from the receptacle, and by depressing the raised operating member, thereby moving the safety means to a position that does not interfere with the spring catch, the catch can be manually inserted or retracted as desired. A second tab can be cut out of the opposite wall and bent inwardly to bear upon the safety tab in order to provide extra resiliency to the safety means for returning the safety tab to its normal position when the raised operating member is released. Also, the end of the safety tab may be twisted as necessary to provide the desired interference with the spring catch.

In another embodiment of the present invention, the receptacle is constructed of an elongated strip of material having its ends folded together forming a hollow oval shaped housing, and a pair of posts extend across the interior of the housing. Alternatively, a pair of tabs can be cut out of one side of the housing and secured through the opposite wall of the housing. A means for securing the housing to the terminated end of a chain is provided, and a spring catch as described above can be inserted into the housing between the posts or tabs and released causing the outwardly directed hooks to engage the posts or tabs and secure the spring catch to the receptacle.

In yet another embodiment of the present invention, the front face of the receptacle is formed with a relatively large central opening and a pair of laterally disposed slots each ending in a recess for receiving and retaining the ends of an elongated spring catch arm. For cooperating with this receptacle, the ends of the elongated arms of the spring catch are each provided with a vertically arranged retaining element which is capable of passing through the central opening in the receptacle and engaging the receptacle by being received in the recesses.

Other features and advantages of the present invention will become apparent from the following detailed description, taken in conjunction with the accompanying drawings, which illustrate, by way of example, the principals of the invention.

BRIEF DESCRIPTION OF THE DRAWINGS

FIG. 1 is a perspective view of a jewelry chain clasp embodying the present invention, illustrated assembled on a conventional jewelry chain, and in a separated position;

FIG. 2 is an enlarged, fragmentary, partly sectional view of the jewelry chain clasp of FIG. 1, and illustrated with the clasp in the connected position;

FIG. 3 is an enlarged, fragmentary plan view of one end of the receptacle of FIG. 1 illustrating, in a closed position, a means for attaching a chain link thereto;

FIG. 4 is a perspective view of the portion of the receptacle shown in FIG. 3, and illustrated in the open position for receiving a chain link thereon;

FIG. 5 is an enlarged, fragmentary, cross-sectional view of the receptacle of FIG. 1 taken substantially along line 5—5 of FIG. 1;

FIG. 6 is a perspective view of an alternative embodiment of a spring catch for use with the jewelry chain clasp of the present invention;

FIG. 7 is a fragmentary, partly sectional view, similar to that of FIG. 5, and illustrating a double leg termination type of receptacle;

FIG. 8 is a fragmentary view of a double leg termination type of receptacle taken in the direction of line 8 in FIG. 7;

FIG. 9 is a perspective view of a receptacle for use in the jewelry chain clasp of the present invention, and illustrated having a movable safety means therein;

FIG. 10 is an enlarged, fragmentary, partly sectional view, taken generally along line 10—10 of FIG. 9, and illustrated as used in connection with a spring catch;

FIG. 11 is a perspective view of an alternative embodiment of a receptacle for use with the present invention;

FIG. 12 is an enlarged cross-sectional view of the receptacle of FIG. 11 taken along line 12—12 of FIG. 11;

FIG. 13 is a perspective view of another alternative embodiment of a jewelry chain clasp embodying the present invention, illustrated assembled on the terminated ends of a jewelry chain, and in a separated position;

FIG. 14 is an enlarged, fragmentary, partly sectional view of the jewelry chain clasp of FIG. 13, and illustrated in the connected position; and FIG. 15 is a perspective view of the alternative embodiment of a receptacle as shown in FIG. 11, and illustrating a slightly modified construction thereof.

DETAILED DESCRIPTION

As shown in the exemplary drawings, the present invention is embodied in a clasp, indicated generally by reference numeral 20 in FIG. 1, for releasably connecting the terminated end links 22 and 24 of a jewelry chain 26. In manufacturing an article of jewelry which includes a jewelry chain, such as a necklace or bracelet, the jeweler or jewelry manufacturer cuts the chain 26 to the desired length for the article being manufactured and a means for connecting the terminated ends is then attached to the length of chain so that the ultimate consumer of the article will be able to easily and conveniently connect and disconnect the ends in the normal use thereof.

It will be appreciated that a clasp comprised of relatively few pieces which requires no complicated steps in assembling onto a chain has a potential for saving jewelry manufacturers a considerable sum of money in manufacturing costs. Further, such a device would appear even more attractive to jewelry manufacturers if it included features which are considered advantageous and desirable by the consumers of such jewelry.

In accordance with the present invention, the jewelry clasp 20 is comprised to two unitary pieces which may be attached directly to the end links 22 and 24 of the jewelry chain 26 without requiring the use of an auxiliary connecting device such as a jump ring. The two pieces include a spring catch 28 arranged to be received within a receptacle 30 which may be provided with a movable safety means 32 (FIG. 10) for preventing inadvertent disconnection of the catch from the receptacle. Further, the jewelry clasp 20 of this invention is relatively inexpensive to manufacture, is trouble free and reliable in use, and a light weight and attractive chain link receiving means 34 on the receptacle 30 is arranged in a novel manner for preventing inadvertent opening of the means when subjected to a tensile load in the chain 26.

In the embodiment of the jewelry chain clasp illustrated in FIG. 1, the spring catch 28 is formed of a unitary elongated piece of material which has been formed into a chain link retaining loop 36 at its mid point with the two ends of the material crossing over and in light contact with one another at 38. The ends of the material are then formed into a pair of generally arcuate arms 40 and 42 each of which terminates in a generally flat outwardly disposed hook 44 and 46. To facilitate manual operation of the spring catch 28, the outer surface of the arcuate arms 40 and 42 may be knurled or scored as at 48.

The hooks 44 and 46 are flattened so that when the arms 40 and 42 are depressed toward one another, the hooks can overlap and still occupy relatively little space. To facilitate overlapping, the hooks 44 and 46 are provided with oppositely facing bevelled surfaces 45 and 47 respectively. Further, each of the arms 40 and 42 is provided with an abrupt shoulder 41 and 43 adjacent the hooks 44 and 46 to prevent the hooks from passing beyond one another when the arms are depressed. The loop 36 has also been flattened in order to cold work and therefore harden the material in that area thereby causing the majority of the flexing of the spring 28 to occur in the area of the arms 40 and 42.

The terminated end link 24 of the chain 26 can be secured to the spring catch 28 by sliding the link 24 over one end of the catch and onto the loop 36 by lightly separating the catch at 38. To accomodate this assembly, it is necessary that the cross-sectional area at all points along the unitary piece forming the spring catch 28 is less than the area defined by the inside of the link 24. Due to the light contact between the arms at 38, the link 24 is prevented from inadvertently working off of the spring catch 28.

Occasionally, the area defined by the inside of the chain link 24 will be too small to fit over the catch 28 and onto the loop 36. In this instance, it is customary in the jewelry art to employ specially shaped pliers, or a round, oval or rectangular awl to stretch or reshape the link to the desired size or shape. In a situation where this procedure would unduly weaken the chain, a jump ring can be used to connect the catch 28 to the chain. A jump ring can also be used where the chain is so large that the catch would have to be separated at 38 beyond its elastic limit to slide the link 24 onto the loop 36.

The receptacle 30 is also constructed of a unitary piece of material which is formed into an axially extending leg 50 and a generally triangular body portion 52. The body portion 52 is comprised of upper and lower oblique walls 54 and 56 which support a front face 58 disposed in a plane generally perpendicular to the leg 50. The upper and lower walls 54 and 56 are secured together by a tab 60 in a manner which will be described in greater detail hereinafter.

A horizontally disposed elongated opening 62 is centrally arranged in the front face 58 of the receptacle 30 for receiving and retaining the hooks 44 and 46 of the spring catch 28. As can best be seen in FIG. 2, the opening 62 is provided with a lip 64 around its periphery which is directed inwardly with respect to the body 52. The lip 64 cooperates with the hooks 44 and 46, which are biased outwardly by the resiliency of the arms 40 and 42, to secure the spring catch 28 to the receptacle. Further, the ends 66 (FIG. 1) of the opening 62 are rounded to permit the spring catch 28 to rotate slightly with respect to the receptacle 30 when secured thereto.

The terminated end link 22 of the chain 26 can be secured directly to the leg 50 of the receptacle 30 without requiring an auxiliary connecting means such as a jump ring. Toward this end, as can best be seen in FIGS. 3 and 4, the leg 50 is provided with an aperture 68 near its end, and a lateral cut 70 is made between the aperture 68 and the side of the leg 50. The terminated end link 22 of the chain 26 can then be assembled directly on the leg 50 by twisting the end of the leg 50, thereby separating the material at the cut 70, and sliding the end link 22 over the exposed end of the material, as illustrated in FIG. 4. By thereafter closing the cut 70 to its original position (FIG. 3), the chain 26 is securely attached directly to the leg 50. As with the spring catch 28 above, in order to accommodate this assembly, it is necessary that the cross-sectional area of the material between the aperture 68 and the sides and end of the leg 50 is less than the area defined by the inside of the link 22. Further, a jump ring may be employed where the link 22 is either too small or too large to accommodate this assembly as described above in connection with the spring catch 28.

In the preferred embodiment of the present invention, the cut 70 is made along an irregular path, such as a dove-tail shaped path. In this way, after the chain 26 has been assembled on the leg 50 and the cut 70 has been closed, the cut 70 will resist any tendency to reopen when subjected to a tensile load in the chain 26. In order to provide adequate room to make the dove-tail shaped cut 70, the aperture 68 can be offset from the longitudinal axis of the leg 50, thereby providing a greater distance between the aperture 68 and the side of the leg 50 on the side where the cut 70 is made than on the opposite side. Naturally, the aperture 68 should not be offset to the extent that the link 22 will no longer fit over the exposed end of the material at the cut 70. Further, where even greater security is desired, the cut 70 can be soldered closed after assembly onto the link 22 without deleteriously effecting the receptacle 30.

For securing the lower wall 56 to the upper wall 54 of the body 52, as can best be seen in FIG. 5, the tab 60, which is an extension of the lower wall 56, projects through a slot 72 in the upper wall and is folded upwardly against the upper wall. In order to protect a user from any sharp edge which may exist at the sheared end of the tab 60, the tab 60 is folded into a recess 74 in the upper wall 54. Similarly, the sheared end 76 (FIG. 1) of the lower wall 56 is secured against a cooperating recess 78 in the leg 50. The tab construction employed herein is designed to hold the walls 54 and 56 rigidly together thereby strengthening the body 52 by constraining the walls from displacement from one another.

An alternative embodiment of the spring catch 28 is illustrated in exemplary FIG. 6. In this instance the spring catch 28' is also of the type having outwardly directed hooks 44' and 46' similar to that previously discussed in connection with the spring catch of FIGS. 1 and 2, and parts of the spring catch of FIG. 6, which find substantial correspondence in structure and function to those previously discussed in connection with FIGS. 1 and 2, have been designated with corresponding primed reference numerals. The spring catch 28' includes a chain link retaining loop 36' which is closed at a point 38' where the arcuate arms 40' and 42' lightly contact one another in the free position of the catch 28'.

In this way, the arms 40' and 42' provide the resiliency required to retain the hooks 44' and 46' within a receptacle 30, and the loop 36' is closed at 38' for preventing a link of jewelry chain from inadvertently working off of the spring catch 28'.

An alternative embodiment of the leg 50 is illustrated in exemplary FIGS. 7 and 8 wherein parts finding substantial correspondence in structure and function to those previously discussed in connection with FIGS. 1–5 have been designated with corresponding primed reference numerals. In this instance, the leg 50' is constructed of a double thickness of material comprised of an extension of the upper wall 54' and an extension of the lower wall 56'. For holding the two thicknesses of the leg 50' together, a tab 60' projects through a slot 72' and is folded into a recess 74' in the upper wall 54'.

As can best be seen in FIG. 8, the leg 50' is provided with an aperture 68' for receiving the terminated end of a jewelry chain. In order that the chain may be assembled directly upon the leg 50', a cut 70' is made between the aperture 68' and the side of the leg 50'. In this instance, the cut 70' may be straight since the double thickness of the leg 50' is sufficiently strong to resist opening of the cut 70' when subjected to a tensile load in the jewelry chain.

For preventing inadvertent disconnection of the spring catch 28 from the receptacle 30, the movable safety means 32 (FIG. 10) is provided within the body 52. For the purpose of describing this feature of the invention, reference will be made to exemplary FIGS. 9 and 10 wherein, again, primed reference numerals will be employed to designate parts having substantial correspondence in structure and function to those described above. As can best be seen in FIG. 9, a double leg receptacle 30' is illustrated having the safety means 32 formed of a tab 80 cut out of the lower wall 56', and an oppositely facing tab 82 cut out of the upper wall 54' for cooperating with the tab 80 as described hereinbelow. Since the tabs 80 and 82 are cut out of the central portions of the lower and upper walls respectively, the double thickness of the leg 50' is held together by a pair of lateral tabs 84 folded around the side of the receptacle 30'.

As can best be seen in FIG. 10, the tab 80 is bent first outwardly to form a raised operating member 86, and then inwardly ending at a position adjacent to and inside of the opening 62'. In order to present a substantially vertical obstruction adjacent the opening 62', the tab 80 is twisted through an angle of about 90 degrees between the operating member 86 and the opening 62'. In this position, the tab 80 will interfere with and prevent the insertion or retraction of the outwardly disposed hooks on the spring catch 28, which must be depressed into an overlapping relationship to be inserted into or withdrawn from the receptacle 30'.

In order to insert the outwardly disposed hooks of the spring catch 28 into the receptacle 30', the raised operating member 86 must be depressed in the direction of the arrow in FIG. 10 thereby moving the tab 80 to the position indicated in phantom line. With the tab 80 in this position, the hooks on the spring catch 28 may be inserted into the receptacle 30' as is also shown in phantom line in FIG. 10. When the spring catch 28 is released causing the outwardly exposed hooks to engage the receptacle 30' as described above, the tab 80 will return to its normal position between the hooks thereby preventing the hooks from being moved into an overlapping relationship for removal from the receptacle. In order to provide added resiliency for returning the tab 80 to its normal position, the tab 82 is bent inwardly and engages the inside of the raised operating member 86.

An alternative embodiment of a receptacle 90 for use with the jewelry chain clasp of the present invention is illustrated in exemplary FIGS. 11 and 12. The receptacle 90 includes a chain receiving leg 92 and a hollow, oval shaped body 94 formed by folding the ends of a strip of material together. One end of the hollow body portion 94, opposite the leg 92, forms an opening 96 for receiving the hook ends of a spring catch (not shown).

In order to provide a means for securing the hooks of the spring catch within the receptacle 90, a pair of cylindrical posts 98 extend across the hollow interior of the body 94 and are secured through the opposite walls of the body, as can best be seen in FIG. 12. If desired, the receptacle 90 can be constructed of a unitary piece of material by replacing the posts 98 with a pair of tabs cut out of one wall of the body 94 and bent inwardly to extend across the hollow interior of the body as shown in FIG. 15. The tabs can then be secured through the opposite wall of the body to provide a rigid means for securing the hooks of a spring catch.

Another alternative embodiment of the present invention is illustrated in exemplary FIGS. 13 and 14 and includes a receptacle 100 constructed of a unitary piece of material and a spring catch 102 also constructed of a unitary piece of material. The receptacle 100 includes a chain receiving leg 104, upper and lower oblique walls 106 and 108, and a front face 110 supported by the upper and lower walls and arranged in a plane generally perpendicular to the leg 104.

A generally vertical opening 112 is centrally arranged in the face 110, and a pair of slots 114 extend laterally from the opening 112 terminating in a pair of recesses 116 which open rearwardly into the inside of the receptacle 100. The front face 110 is preferably recessed rearwardly into the receptacle 100, as at 118, to prevent a user from contacting any sharp edges which may exist around the opening, slots or recesses.

For cooperating with the receptacle 100, the spring catch 102 includes a pair of arcuate spring arms 120 each having a generally flat enlarged retaining portion 122 arranged vertically and longitudinally at the end thereof. By depressing the arms 120 toward one another, the retaining portions 122 are moved into a parallel abutting relationship and may be inserted through the opening 112. Upon releasing the spring catch 102, the arms 120 will move laterally through the slots 114 permitting the retaining portions 122 to seat into the recesses 116, as shown in FIG. 14. Preferably, the vertical dimension of the retaining portions 122 is at least two times the width of the slots 114.

For securing the spring catch 102 to a jewelry chain, the catch is provided with a chain link retaining loop 124 which may be formed either in the cross-over or abutting configuration described in connection with FIGS. 1 and 6 above. Moreover, the embodiment illustrated in FIGS. 13 and 14 could be provided with a movable safety means such as that illustrated in FIGS. 9 and 10. If such a device were included in the receptacle 100, the 90 degree twist in the obstructing tab would preferably not be included so that the tab would provide a generally horizontal obstruction behind the opening 112 and between the retaining portions 122.

From the foregoing, it will be appreciated that the jewelry chain clasp of the present invention provides a device which is comprised of two unitary pieces which may be easily and conveniently attached directly to the terminated ends of a jewelry chain. Further, the clasp of the present invention can be provided with a movable safety means for preventing inadvertent disconnection of the catch from the receptacle, and the various embodiments disclosed present a highly desirable, neat and attractive appearance. Moreover, the clasp of this invention may be fabricated conveniently and economically, and can include a lightweight and attractive chain link receiving means on the receptacle for preventing inadvertent opening of the means when subjected to a tensile load in the chain.

While several particular forms of the invention have been illustrated and described, it will also be apparent that various modifications can be made without departing from the spirit and scope of the invention.

I claim:

1. A jewelry chain clasp adapted to engage the terminal links of a chain, comprising:

a receptacle having a means for engaging a terminal link of a chain and a front face disposed generally in a plane perpendicular to the axis of said chain and having a central opening therein, said opening having an inwardly directed lip around the periphery of said opening; and a unitary spring catch including a chain link engaging loop and a pair of elongated arms each terminating in a means for engaging said receptacle adjacent said opening.

2. A jewelry chain clasp as set forth in claim 1 wherein the cross-sectional area of said spring catch at all points is less than the area defined by the inside of a terminal link of said chain, whereby a link of said chain can pass over said catch to enagage said loop.

3. A jewelry chain clasp as set forth in claim 1 wherein said means for engaging a terminal link of said chain is an axially extending leg on said receptacle having an aperture through said leg near one end thereof and a cut extending between said aperture and one side of said leg, said aperture being arranged such that the cross-sectional area of the material comprising said leg, between said aperture and the sides and end of said leg, is less than the area defined by the inside of a terminal link of said chain, whereby a link of said chain can pass over said area between said aperture and the sides and end of said leg.

4. A jewelry chain clasp as set forth in claim 3 wherein said cut comprises a dove-tail shaped cut between said aperture and the side of said leg.

5. A jewelry chain clasp as set forth in claim 1 wherein said arms form an intersection with one another adjacent said loop and contact one another at said intersection to close said loop.

6. A jewelry chain clasp as set forth in claim 1 wherein said arms abut one another adjacent said loop and contact one another at the abutment to close said loop.

7. A jewelry chain clasp as set forth in claim 1 wherein said central opening comprises a generally horizontally disposed oval opening having rounded lateral ends, and said means for engaging said receptacle is an outwardly directed hook on each arm biased outwardly by said arms for engaging said lateral ends of said opening.

8. A jewelry chain clasp as set forth in claim 7 wherein said hooks engage said lip adjacent said lateral ends of said opening.

9. A jewelry chain clasp as set forth in claim 1 wherein said central opening comprises a generally vertically arranged opening, and a pair of laterally disposed slots connect said opening with a pair of inwardly facing recesses, and said means for engaging said receptacle is a generally flat, enlarged, vertically and longitudinally arranged retaining portion on each arm, biased outwardly by said arms, and arranged to be received in said recesses.

10. A jewelry chain clasp as set forth in claim 9 wherein said retaining portions have a vertical dimension of at least two times the width of said slots.

11. A jewelry chain clasp as set forth in claim 1 wherein said front face is supported by a first wall and a second wall which are held together by a tab extending from said first wall through a slot in said second wall, and said second wall includes a recess for receiving said tab.

12. A jewelry chain clasp as set forth in claim 11 wherein said first wall forms a juncture with said secnd wall, said first wall having a terminal end at said juncture, and said second wall includes a recess for receiving the terminal end of said first wall.

13. A jewelry chain clasp as set forth in claim 1 wherein said receptacle includes a movable safety means for preventing inadvertent disengagement of said spring catch from said receptacle.

14. A jewelry chain clasp as set forth in claim 13 wherein said movable safety means includes a tab in said receptacle which protrudes outwardly of said receptacle forming an operating member, and extends inwardly to a point adjacent said opening for obstructing the ingress and egress of said spring catch through said opening.

15. A jewelry chain clasp as set forth in claim 14 wherein said tab is twisted through about 90 degrees between said operating member and sid opening.

16. A jewelry chain clasp as set forth in claim 14 wherein said receptacle includes a spring tab having a free end engaging said movable safety means for biasing said movable safety means toward said point adjacent said opening.

17. A jewelry chain clasp adapted to engage the terminal links of a chain, comprising:

a receptacle including an axially extending leg having an aperture therethrough for receiving a terminal link of a chain, a hollow, oval-shaped body having an open end forming a front face disposed generally in a plane perpendicular to the axis of said chain, and a pair of vertically disposed posts extending through said hollow body; and a unitary spring catch including a chain link engaging loop and a pair of elongated arms each terminating in a means for engaging one of said vertically disposed posts.

18. A jewelry chain clasp as set forth in claim 17 wherein said posts are formed integrally with said receptacle and are comprised of a pair of tabs cut from said body portion.

19. A jewelry chain comprising:

a receptacle including an axially extending leg having an aperture therethrough for receiving a single link of one end of a jewelry chain, and a front face disposed generally in a plane perpendicular to the axis of said leg and having a horizontally disposed opening therein having rounded lateral ends, said receptacle including a movable safety means which protrudes outwardly of said receptacle forming an operating member, and extends inwardly to a point adjacent said opening for obstructing the ingress and engress of a spring catch through said opening; and a unitary spring catch comprising an elongated piece of material formed with a loop adjacent its mid point by crossing the ends of the elongated piece over one another, said loop arranged to receive a single link at the other end of said jewelry chain, and the ends of said elongated piece being formed with outwardly disposed hooks for engaging the lateral ends of said opening.

20. A jewelry chain clasp as set forth in claim 19 wherein said receptacle includes a spring tab having a free and engaging said movable safety means for biasing said movable safety means toward said point adjacent said opening.

21. A jewelry chain clasp comprising:

a unitary receptacle including an axially extending leg having an aperture therethrough for receiving a single link of a jewelry chain, upper and lower oblique walls supporting a front face arranged generally in a plane perpendicular to said leg, said face having a central opening therein and a pair of lateral slots connecting said opening with a pair of inwardly facing recesses; and a unitary spring catch including a jewelry chain link engaging loop, and a pair of elongated spring arms each terminating in a generally flat, enlarged, vertically and longitudinally disposed retaining portion, said members being arranged such that, by displacing said arms toward each other, said retaining portions can be inserted into said receptacle through said central opening, and by releasing said arms, said arms move outwardly through said slots, and said retaining portions are received in said recesses.

22. A jewelry chain clasp as set forth in claim 21 wherein said retaining portions have a vertical dimension of at least two times the width of said slots.

* * * * *